US011780066B2

(12) United States Patent
Zhu

(10) Patent No.: US 11,780,066 B2
(45) Date of Patent: Oct. 10, 2023

(54) FASTENER DRIVING TOOL

(71) Applicant: Chongqing Hybest Tools Group Co., Ltd., Chongqing (CN)

(72) Inventor: Yimin Zhu, Chongqing (CN)

(73) Assignee: CHONGQING HYBEST TOOLS GROUP CO., LTD., Chongqing (CN)

( * ) Notice: Subject to any disclaimer, the term of this patent is extended or adjusted under 35 U.S.C. 154(b) by 0 days.

(21) Appl. No.: 17/646,809

(22) Filed: Jan. 3, 2022

(65) Prior Publication Data

US 2022/0339767 A1 Oct. 27, 2022

(30) Foreign Application Priority Data

Apr. 25, 2021 (CN) ..... 202110448918.2

(51) Int. Cl.
*B25C 1/04* (2006.01)

(52) U.S. Cl.
CPC ..... *B25C 1/041* (2013.01); *B25C 1/047* (2013.01)

(58) Field of Classification Search
CPC ..... B25C 1/041; B25C 1/047; B25C 1/008; B25C 1/04; B25C 1/06
See application file for complete search history.

(56) References Cited

U.S. PATENT DOCUMENTS

2015/0114187 A1* 4/2015 Huang ..... B25C 1/04 81/489
2018/0126528 A1* 5/2018 Pomeroy ..... B25C 1/06
2021/0308852 A1* 10/2021 Ueda ..... B25C 1/047

* cited by examiner

*Primary Examiner* — Anna K Kinsaul
*Assistant Examiner* — Veronica Martin
(74) *Attorney, Agent, or Firm* — Hamre, Schumann, Mueller & Larson, P.C.

(57) ABSTRACT

A fastener driving tool includes a cylinder, a piston movably disposed within the cylinder, a striking rod operable by the piston and having lift teeth, and a lift and release mechanism for lifting and releasing the striking rod and the piston. The mechanism includes a rotatable toothed disc which has disc teeth that sequentially engage with the lift teeth as the striking rod is lifted from a lower driven position toward an upper retracted position. The toothed disc is movable relative to the striking rod with a torque generated as a result of a non-meshing interference to bring the rotating axis of the toothed disc into deflection away from the striking rod for releasing the interference, and is further biased by a biasing member back to its original position.

9 Claims, 8 Drawing Sheets

FASTENER DRIVING TOOL

CROSS-REFERENCE TO RELATED APPLICATION

This application claims priority of Chinese Patent Application No. 202110448918.2, filed on Apr. 25, 2021.

FIELD

The disclosure relates to a fastener driving tool, and more particularly to a fastener driving tool with a release and lift mechanism for moving a piston and a striking rod between a retracted position and a driven position.

BACKGROUND

A conventional handheld fastener driving tool is used for driving fasteners (such as nails, staples, etc.) into a workpiece. During driving of the tool, a fastener jam might occur. As such, a gas spring fastener driver, such as that disclosed in U.S. Pat. No. 10,632,601, includes a jam release and lifter mechanism, which has a complicated construction for performing jam release operation.

SUMMARY

Therefore, an object of the disclosure is to provide a fastener driving tool that can alleviate at least one of the drawbacks of the prior art.

According to the disclosure, the fastener driving tool includes a cylinder, a piston movably disposed within the cylinder, a rack-like striking rod connected with and operable by the piston and extending along an up-down direction to be moved from an upper retracted position to a lower driven position, and a lift and release mechanism for lifting and releasing the striking rod and the piston. The striking rod has a plurality of lift teeth arranged along the up-down direction. The lift and release mechanism includes a toothed disc which is rotatable about a rotating axis that is transverse to the up-down direction and which has a plurality of disc teeth that are arranged along a peripheral portion of the toothed disc and extend parallel to the rotating axis to sequentially engage with the lift teeth as the striking rod is lifted from the lower driven position toward the upper retracted position with rotation of the toothed disc. The toothed disc is movable relative to the striking rod with a torque generated as a result of a non-meshing interference of a first disc tooth on the toothed disc with one of the lift teeth of the striking rod during movement of the striking rod between the lower driven position and the upper retracted position, to bring the rotating axis into deflection away from the striking rod for releasing the interference. The lift and release mechanism further includes a biasing member which biases the toothed disc back to its original position.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
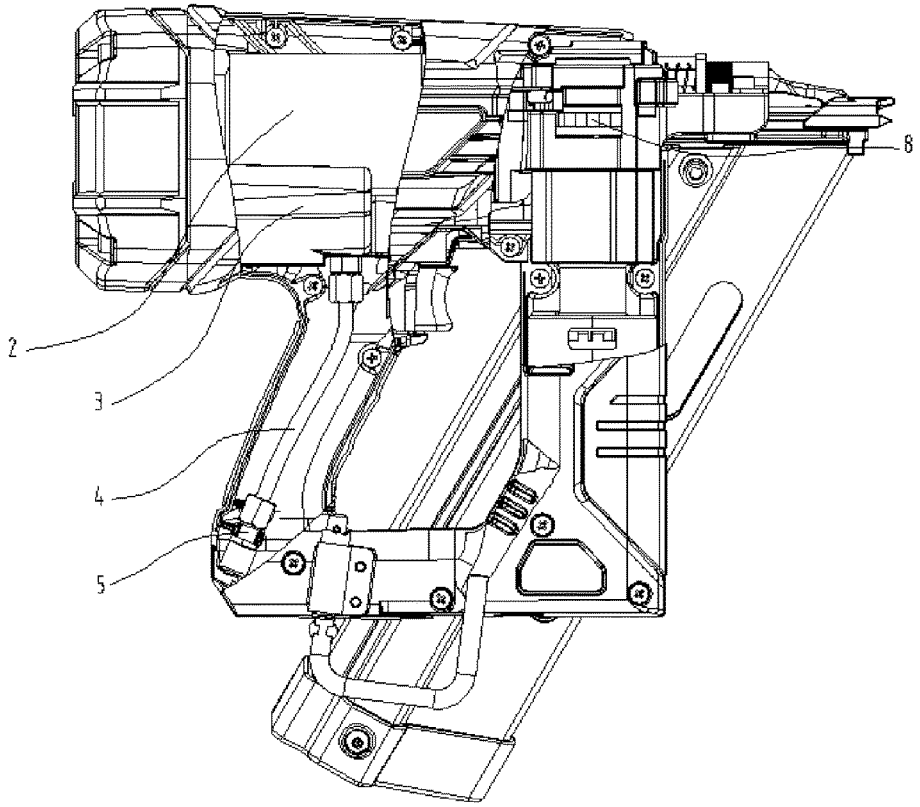
FIG. 1 is a schematic view illustrating an embodiment of a fastener driving tool according to the disclosure.
Figure 2:
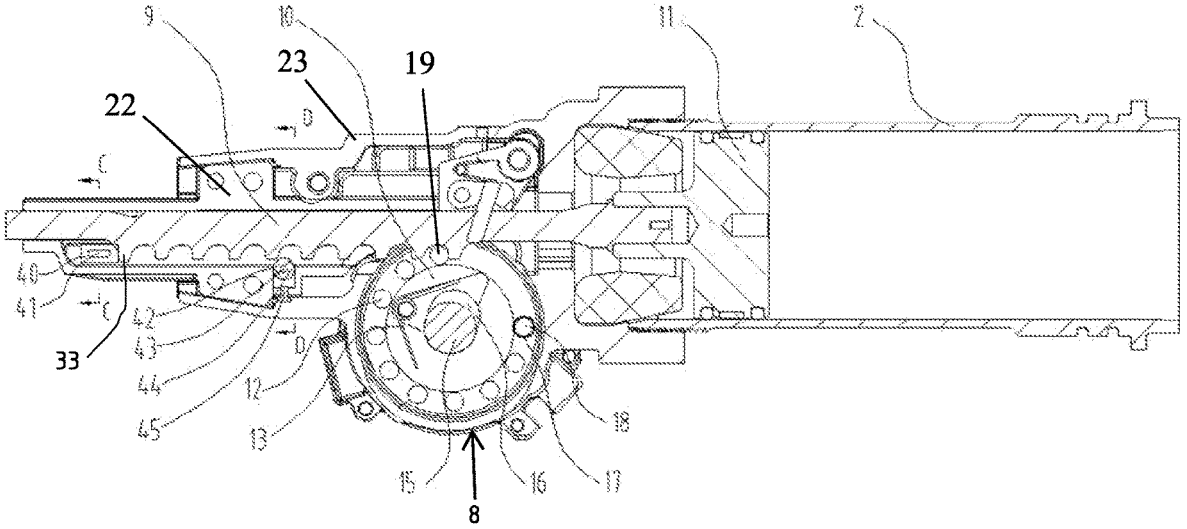
FIG. 2 is a fragmentary, partly-sectional view illustrating a state when a rack-like striking rod meshes with a first disc tooth of a toothed disc in a normal meshing state.
Figure 3:
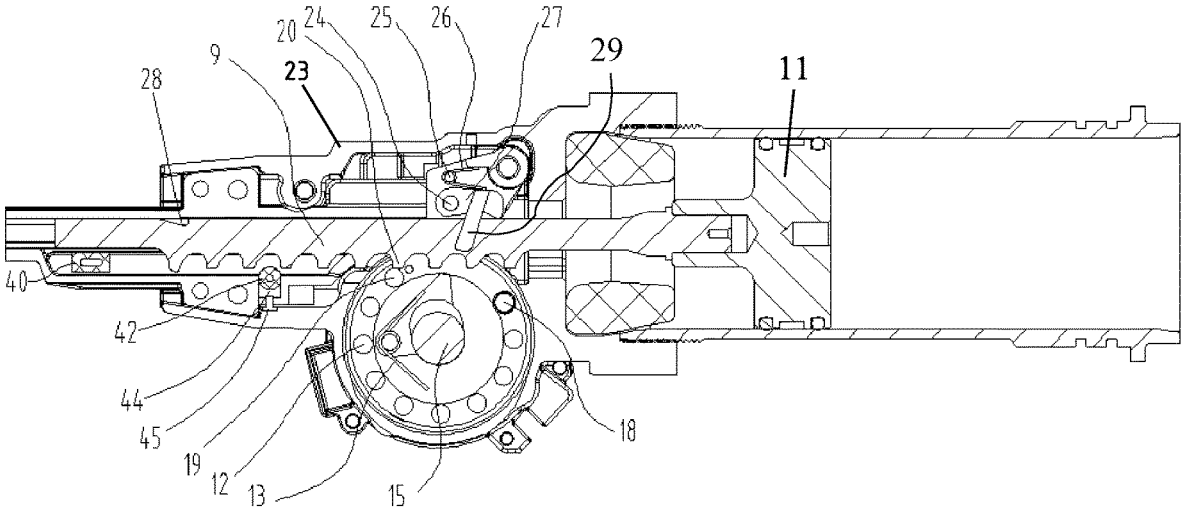
FIG. 3 is a fragmentary, partly-sectional view illustrating a state when the striking rod undergoes non-meshing interference by the toothed disc during striking of a fastener.
Figure 7:
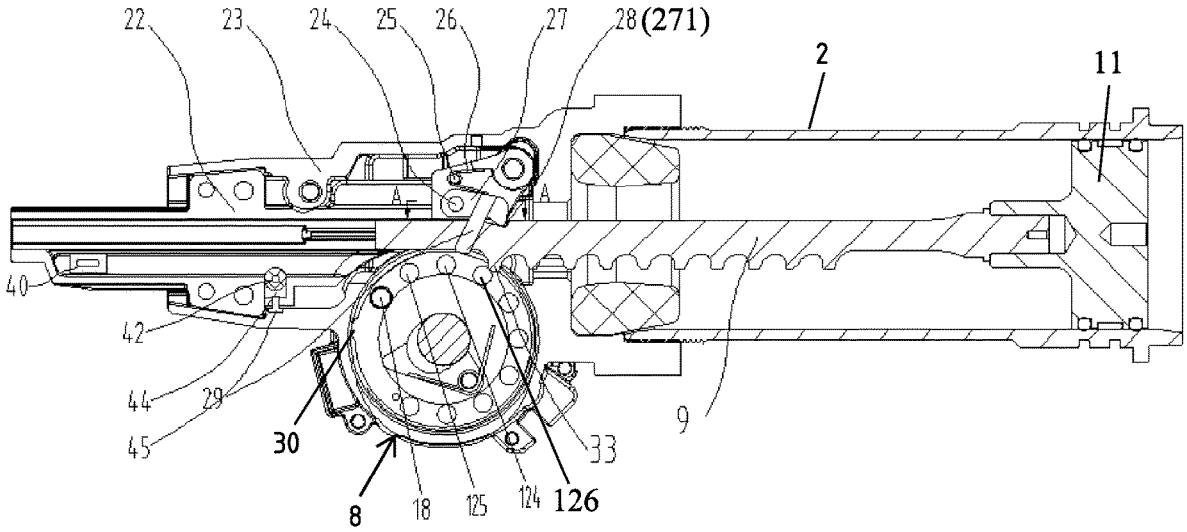
FIG. 7 is a fragmentary, partly-sectional view illustrating a state when a piston and the striking rod just reach an upper retracted position, some disc teeth have not been moved over a terminal lift tooth of the striking rod, and a ratchet pawl is engaged in a notch of the striking rod.
Figure 8:
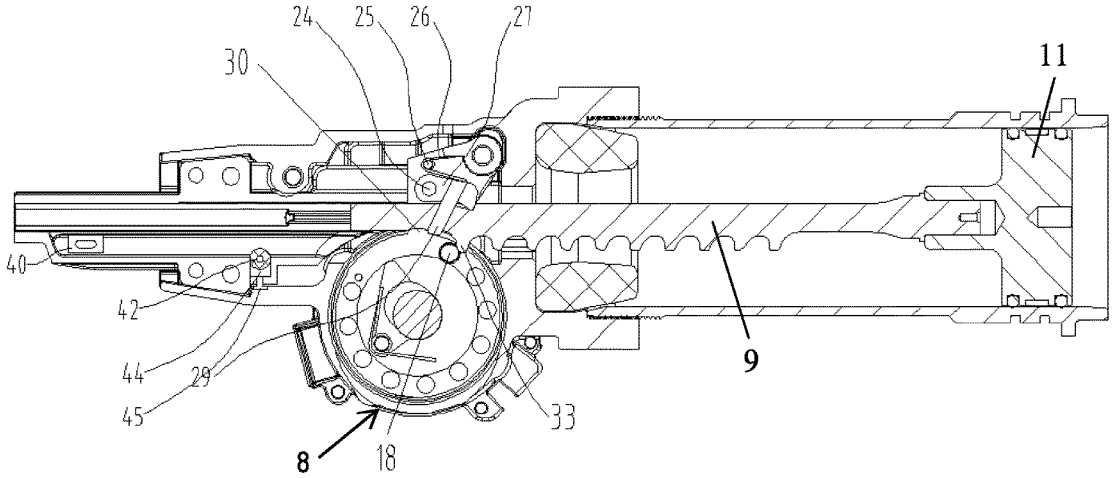
FIG. 8 is a fragmentary, partly-sectional view illustrating a state when a piston and the striking rod are in the upper retracted position, a terminal disc tooth of the toothed disc meshes with the terminal lift tooth of the striking rod, and a thrust protrusion of the toothed disc abuts against the ratchet pawl.
Figure 9:
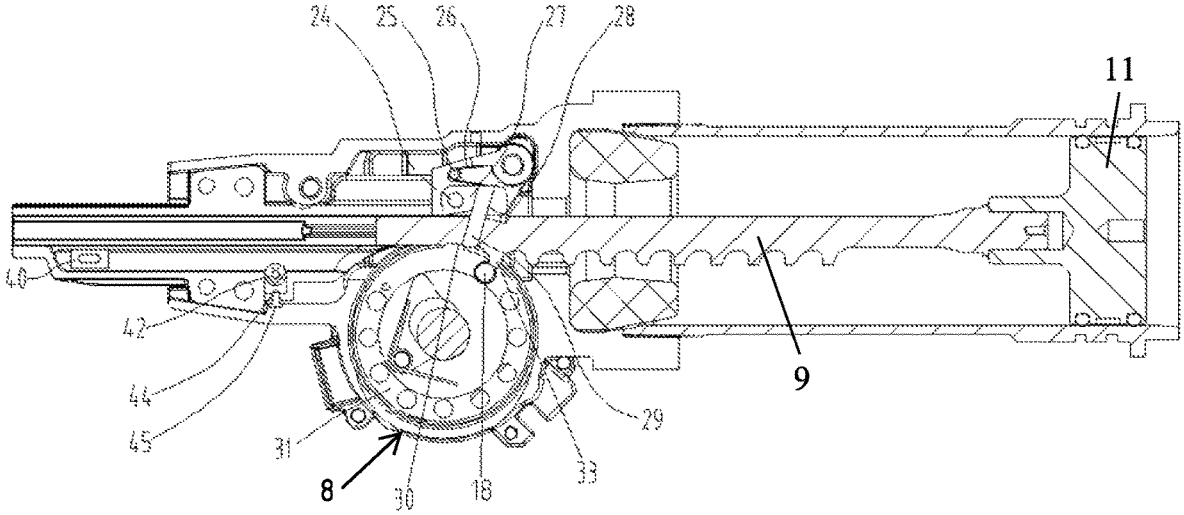
FIG. 9 is a fragmentary, partly-sectional view illustrating a state when a piston and the striking rod are in the upper retracted position, the terminal disc tooth of the toothed disc is moved over the terminal lift tooth of the striking rod, and the thrust protrusion thrusts the ratchet pawl.
Figure 10:
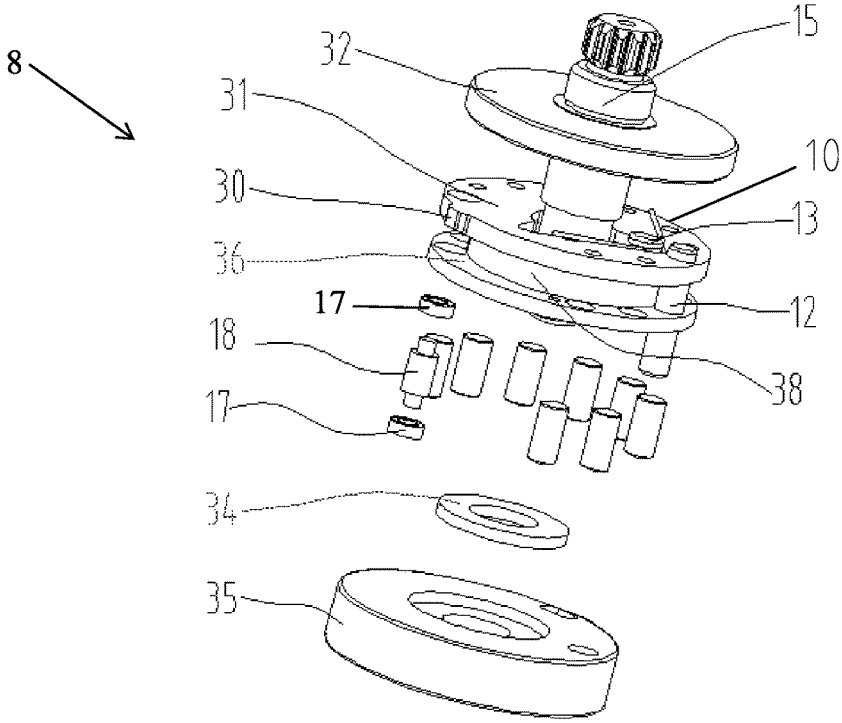
FIG. 10 is an exploded perspective view of a lift and release mechanism of the embodiment.
Figure 11:
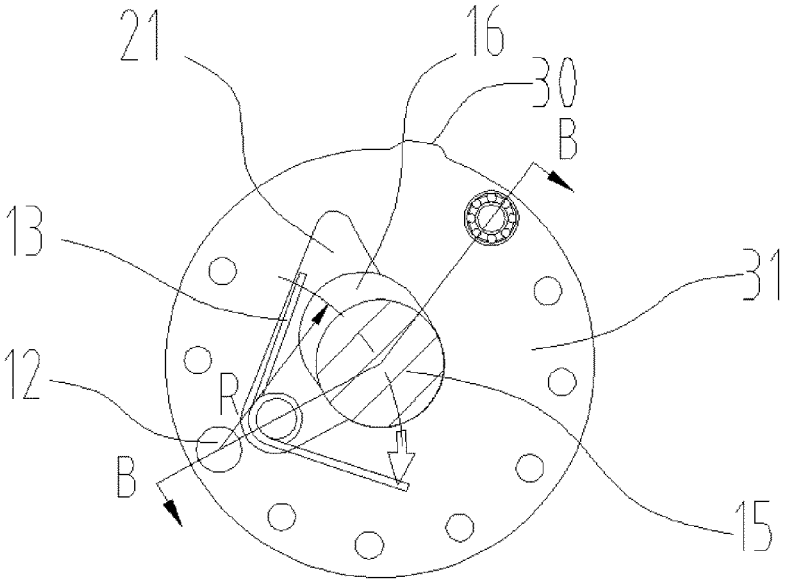
FIG. 11 is a cross-sectional view of the lift and release mechanism of the embodiment.
Figure 12:
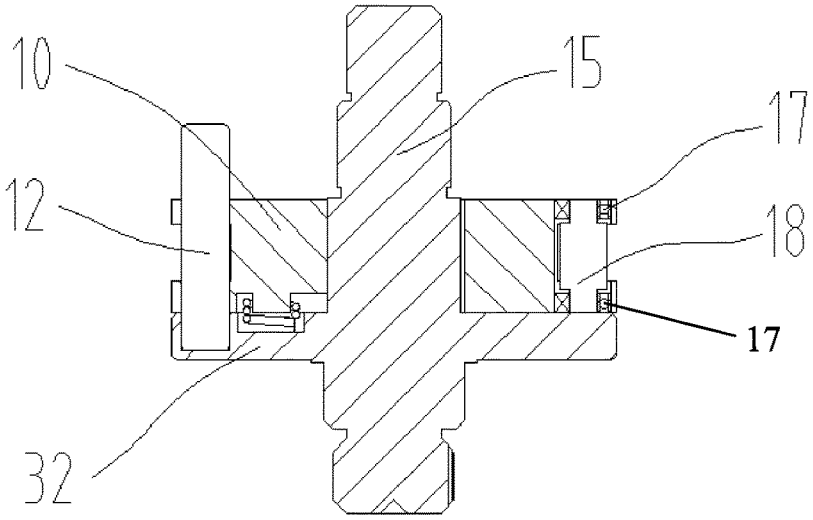
FIG. 12 is a sectional view taken along line B-B of FIG. 11.
Figure 13:
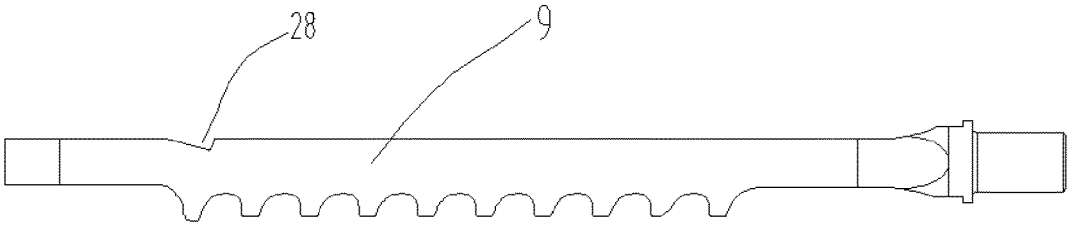
FIG. 13 is a schematic view of the striking rod of the embodiment.
Figure 15:
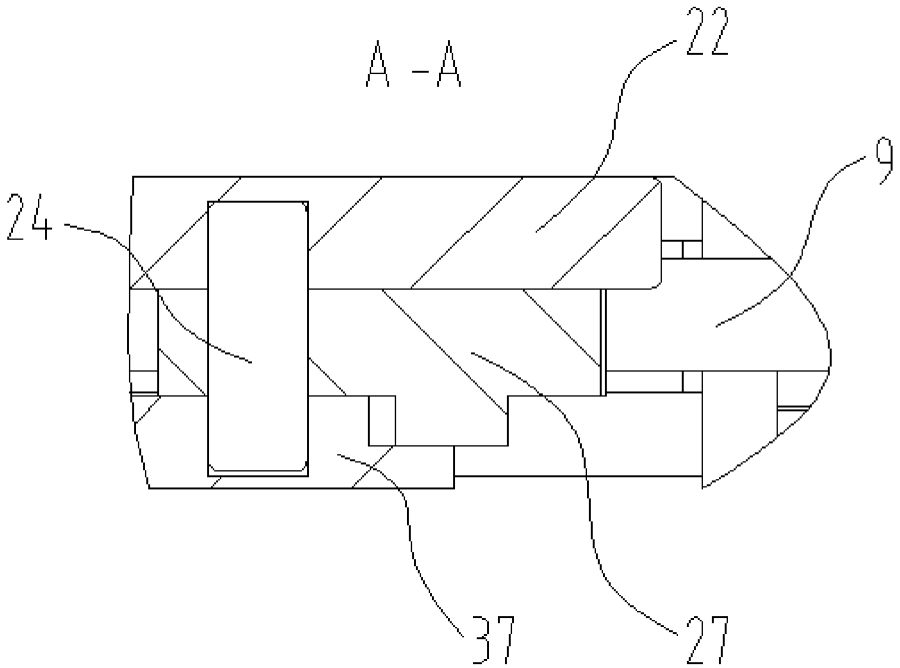
FIG. 15 is a sectional view taken along line A-A of FIG. 7.

Referring to FIGS. 1, 2 and 3, a fastener driving tool according to the disclosure includes a cylinder 2, a cylinder seat 23 on which a front head portion 22 (see FIGS. 7 and 15) and a rear head portion 37 (see FIG. 15) are mounted, a piston 11 movably disposed within the cylinder 2, a rack-like striking rod 9 connected with and operable by the piston 11 and extending along an up-down direction to be moved from an upper retracted position to a lower driven position, and a lift and release mechanism 8 for lifting and releasing the striking rod 9 and the piston 11. The striking rod 9 has a plurality of lift teeth 20 arranged along the up-down direction. During movement of the striking rod 9 between the lower driven position and the upper retracted position, when the striking rod 9 does not mesh with and undergoes interference by a first disc tooth 19 of a toothed disc 10 of the lift and release mechanism 8, the toothed disc 10 is deflected away from the striking rod 9 for releasing the interference. After releasing of the interference, the toothed disc 10 is biased by a biasing member 13 back to its original position.

Figure 4:
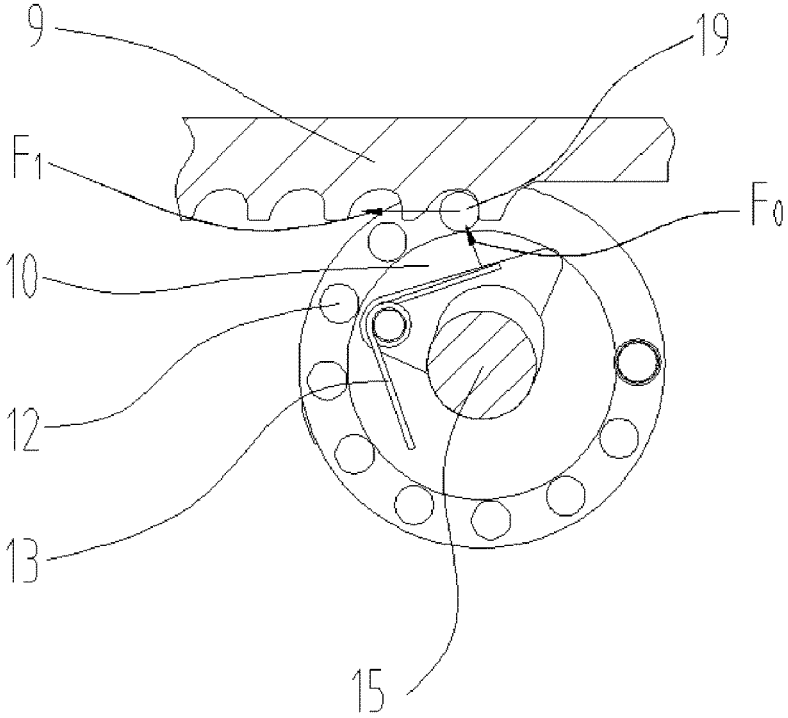
FIG. 4 is a schematic sectional view illustrating that the toothed disc is subject to a force in the normal meshing state.
Figure 5:
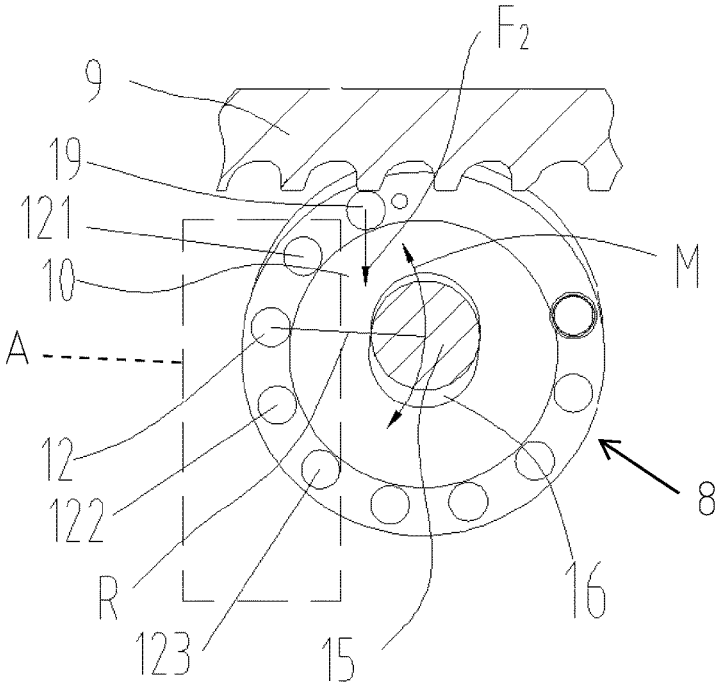
FIG. 5 is a schematic sectional view illustrating that the toothed disc is subject to a force in the non-meshing interfered state.

With reference to FIGS. 4 and 5, specifically, during driving of the fastener driving tool, the biasing member 13 exerts a biasing force (F0) to the toothed disc 10 to generate a counterclockwise torque (T0) of the toothed disc 10. When the non-meshing interference of the lift teeth 20 of the striking rod 9 by the first disc tooth 19 of the toothed disc 10 occurs, the striking rod 9 exerts an interfering force (F2) to the toothed disc 10 to generate a clockwise torque (T2). Once the clockwise torque (T2) is larger than the counterclockwise torque (T0), the toothed disc 10 is deflected clockwise so as to release the interference between the first disc tooth 19 of the toothed disc 10 and the lift teeth 20 of the striking rod 9 to enter a normal meshing state. A deflected route of the toothed disc 10 is indicated by the arrowed line M in FIG. 5.

Accordingly, in one embodiment, in terms of a portion of the toothed disc 10 where the interfering force (F2) is exerted, a deflected center of the toothed disc 10 is defined at an opposite side relative to the piston 11 (see FIG. 2). That is, any portion in a region (A) at a left side of the toothed disc 10 as shown in FIG. 5 may be defined as the deflected center of the toothed disc 10. For example, any one of the disc teeth 121, 12, 122 and 123 may serve as a deflected axle of the toothed disc 10. In this embodiment, one disc tooth 12 is fixed to a peripheral portion of the toothed disc 10 to serve as the deflected axle, and defines a deflected axis that coincides with the deflected center of the toothed disc 10.

Figure 6:
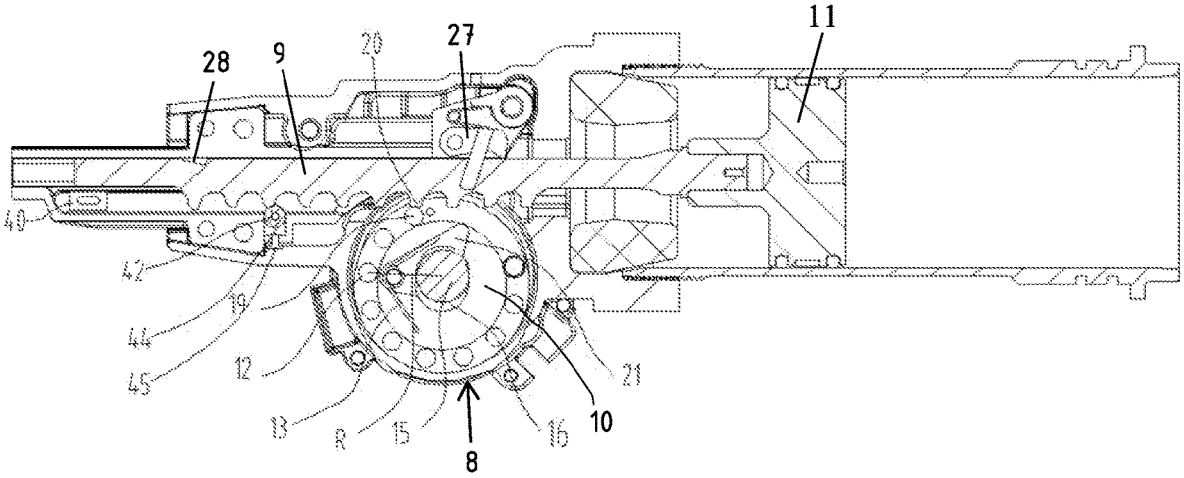
FIG. 6 is a fragmentary, partly-sectional view illustrating a state when the toothed disc is deflected in the non-meshing interfered state.

With reference to FIGS. 2 and 3 and FIGS. 5 to 10, specifically, the lift and release mechanism 8 includes a driving shaft 15 which defines a rotating axis that is transverse to the up-down direction, and the toothed disc 10 connected with the driving shaft 15. The toothed disc 10 is rotatable about the rotating axis and has a plurality of the disc teeth which are arranged along a peripheral portion of the toothed disc 10 and extend parallel to the rotating axis to sequentially engage with the lift teeth 20 as the striking rod 9 is lifted from the lower driven position toward the upper retracted position with rotation of the toothed disc 10. Each disc tooth is cylindrical with a circular cross-section. The toothed disc 10 has an arcuate hole 16 through which the driving shaft 15 extends to rotate the toothed disc 10 about the rotating axis. The arcuate hole 16 extends along a curve which surrounds the deflected axis and has a radius R as shown in FIG. 5. Referring to FIG. 6 and FIGS. 10 to 13, the lift and release mechanism 8 further includes a first carrier half 35 and a second carrier half 32 between which the toothed disc 10 is interposed, and an O-ring 34 which is interposed between the first carrier half 35 and the toothed disc 10. The driving shaft 15 is supported on the first and second carrier halves 35, 32. The disc tooth 12 which serves as the deflected axle extends through the toothed disc 10 and has two ends which are respectively fixed to the first and second carrier halves 35, 32. Hence, the fixed disc tooth 12 is meshable with the lift teeth 20 of the striking rod 9, and serves as the deflected axle of the toothed disc 10. In this embodiment, a third disc tooth of the toothed disc 10 is provided as the fixed disc tooth 12. The toothed disc 10 includes an upper circular disc 31, a lower circular disc 36 and a connecting portion 38. A diameter of the connecting portion 38 is smaller than that of each of the upper and lower circular discs 31, 36. The disc teeth are formed outwardly and surround the connecting portion 38. The two ends of the fixed disc tooth 12 respectively extend through the upper and lower circular discs 31, 36. A terminal disc tooth 18 has two ends rollably mounted on the upper and lower circular discs 31, 36 by virtue of bearings 17 so as to be rollable relative to the toothed disc 10. The other disc teeth are securely connected to the upper and lower circular discs 31, 36. The biasing member 13 is in the form of a torsion spring which is disposed between the second carrier half 32 and the upper circular disc 31 of the toothed disc 10 and which has two ends respectively abutting against a groove in the second carrier half 32 and a groove 21 in the upper circular disc 31. During lifting of the striking rod 9 by the lift and release mechanism 8, the driving shaft 15 is actuated to rotate, and the toothed disc 10, the first and second carrier halves 35, 32, the O-ring 34 and the disc teeth on the toothed disc 10 are rotated synchronously, as shown in FIG. 2. Once the non-meshing interference occurs, the first and second carrier halves 35, 32 are blocked to cause deflection of the toothed disc 10, as shown in FIG. 6.

With reference to FIGS. 7 and 10, and FIGS. 13 to 15, the striking rod 9 has a notch 28 formed in a rear side thereof. The toothed disc 10 has a thrust protrusion 30 projecting outwardly from the peripheral portion of the upper circular disc 31. A ratchet pawl 27 is pivotably mounted on the head of the fastener driving tool by virtue of a pivot pin 24, and is disposed between the front and rear head portions 22, 37. The ratchet pawl 27 has a pawl end 271 which is biased by a biasing spring 26 (a torsion spring) to abut against the rear side of the striking rod 9 and to be engageable in the notch 28 when the striking rod 9 is moved to the upper retracted position. The biasing spring 26 is mounted on the head through a spring pin 25. The ratchet pawl 27 has an actuated portion 29 which extends toward the toothed disc 10. With reference to FIGS. 6 to 9, during the working operation of the fastener driving tool, with the rotation of the toothed disc 10, when the pawl end 271 of the ratchet pawl 27 is engaged in the notch 28, and a terminal lift tooth 33 of the striking rod 9 meshes with the terminal disc tooth 18 on the toothed disc 10, the thrust protrusion 30 abuts against and thrusts the actuated portion 29 to bring the pawl end 271 into disengagement from the notch 28 so as to permit the piston 11 and the striking rod 9 back to their normal striking state. Moreover, during the working operation of the fastener driving tool, with the rotation of the toothed disc 10, when the striking rod 9 is in the upper retracted position, the pawl end 271 of the ratchet pawl 27 is kept in engagement with the notch 28 and an impact generated as a result of sequential meshing of intermediate disc teeth on the toothed disc 10 with the terminal lift tooth 33 is borne by the ratchet pawl 27, until the terminal disc tooth 18 is moved over the terminal lift tooth 33. The intermediate teeth 124, 125 are between a disc tooth 126 which meshes with the terminal lift tooth 33 when the striking rod 9 just reaches the upper retracted position (see FIG. 7), and the terminal disc tooth 18.

Figure 16:
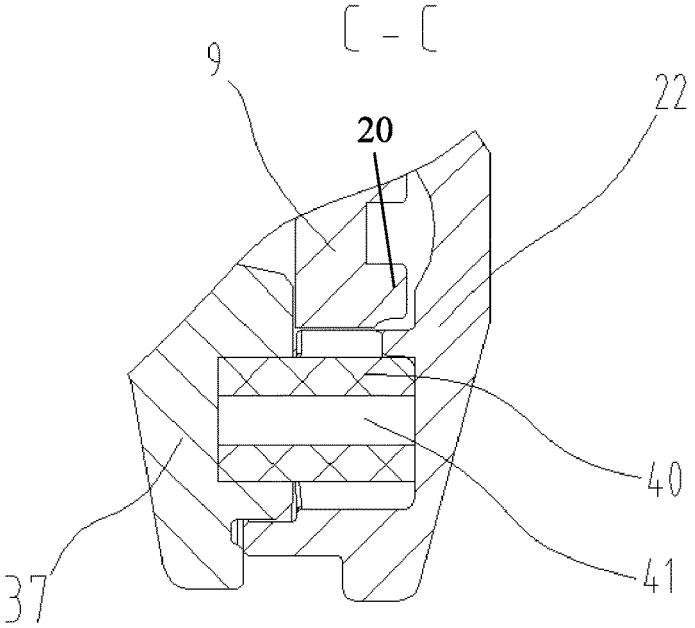
FIG. 16 is a sectional view taken along line C-C of FIG. 2.
Figure 17:
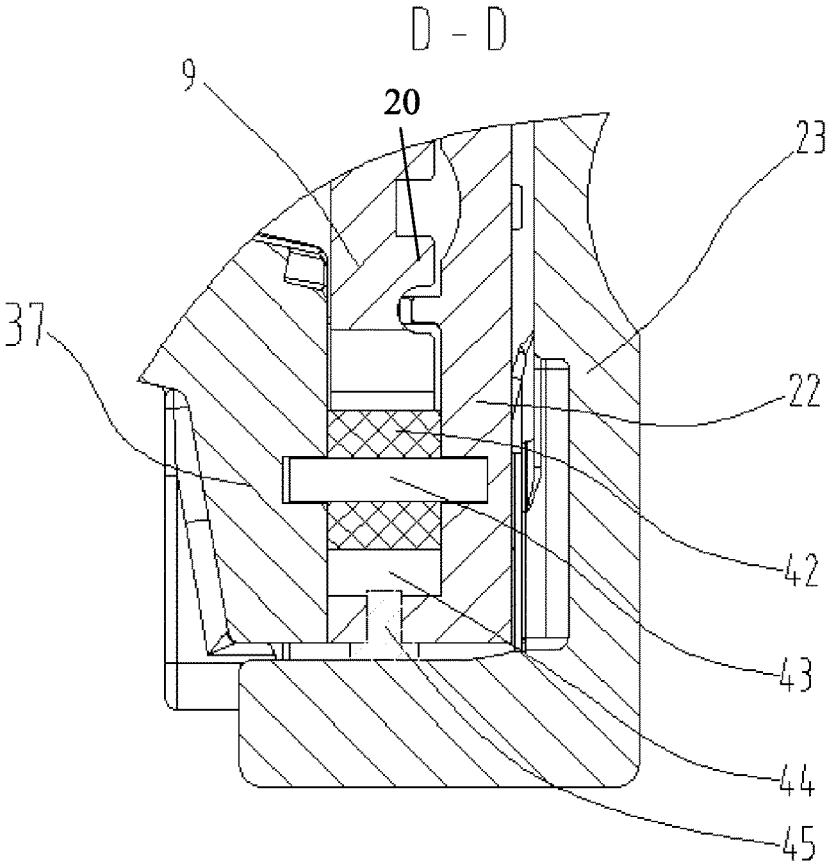
FIG. 17 is a sectional view taken along line D-D of FIG. 2.

With reference to FIGS. 2, 16 and 17, the head of the fastener driving tool defines an oil storing space between the front and rear head portions 22, 37, and an oil filling hole 45 in fluid communication with the oil storing space. The oil storing space is formed to permit oil therein to contact at least the terminal lift tooth 33 of the striking rod 9. Specifically, the oil storing space includes a first sealing compartment 41 and a second sealing compartment 44. A first flexible material 40 is disposed in the first sealing compartment 41 to absorb oil, and a second flexible material 42 is disposed in the second sealing compartment 44 and is rollably mounted between the front and rear head portions 22, 37 by means of a cylindrical pin 43 to be rolled by the movement of the striking rod 9. The lift teeth 20 of the striking rod 9 contact the first and second flexible materials 40, 42 to obtain oil. The first and second flexible materials 40, 42 may be felt, sponge, or any other material that absorbs oil and grease. The second flexible material 42 and the cylindrical pin 43 may be in the form of rollers. The striking rod 9 contacts the flexible materials during the movement in the up-down direction to obtain oil and reduce frictional wearing with the disc teeth on the toothed disc 10 for prolonging the service life of the fastener driving tool.

With reference to FIG. 1, a gas storing chamber 3 for supplying compressed gas to the cylinder 2 is disposed in the housing of the fastener driving tool, and a hose 4 is connected with the gas storing chamber 3 and a gas supplying device 5. The hose 4 is prevented from breakage caused by vibration of the fastener driving tool so as to prolong the service life thereof.

Figure 14:
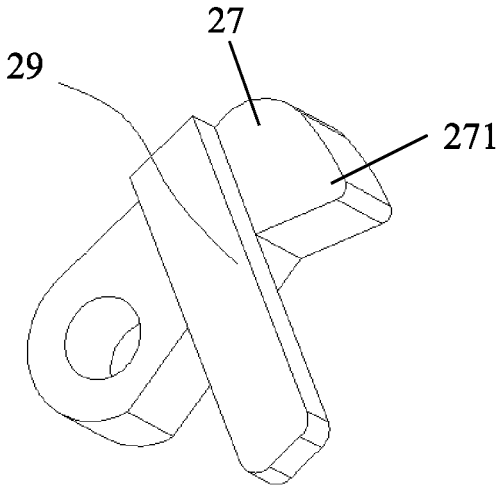
FIG. 14 is a perspective view of the ratchet pawl of the embodiment.

With reference to FIG. 14, the actuated portion 29 may be connected to the ratchet pawl 27, or is integrally formed with the ratchet pawl 27. In another embodiment, except the fixed disc tooth 12, the other disc teeth on the toothed disc 10 may be non-circular disc teeth.

As illustrated, with the lift and release mechanism 8, the toothed disc 10 is movable relative to the striking rod 9 with a torque generated as a result of a non-meshing interference of a first disc tooth 19 with a lift tooth 20 of the striking rod 9 during movement of the striking rod 9 between the lower driven position and the upper retracted position, to bring the rotating axis into deflection away from the striking rod 9 for releasing the interference. The toothed disc 10 is urged by a biasing member 13 back to its original position. The lift and release mechanism 8 has a simple construction to release the jam of fastener. Moreover, the fastener driving tool of the disclosure is operated steadily and flexibly and the service life of the fastener driving tool can be prolonged.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A fastener driving tool comprising:

a cylinder;

a piston movably disposed within said cylinder;

a rack-like striking rod connected with and operable by said piston and extending along an up-down direction to be moved from an upper retracted position to a lower driven position, said striking rod having a plurality of lift teeth arranged along the up-down direction; and a lift and release mechanism for lifting and releasing said striking rod and said piston, said lift and release mechanism including a toothed disc which is rotatable about a rotating axis that is transverse to the up-down direction and which has a plurality of disc teeth that are arranged along a peripheral portion of said toothed disc and extend parallel to the rotating axis to sequentially engage with said lift teeth as said striking rod is lifted from the lower driven position toward the upper retracted position with rotation of said toothed disc, said toothed disc being movable relative to said striking rod with a torque generated as a result of a non-meshing interference of a first disc tooth on said toothed disc with one of said lift teeth of said striking rod during movement of said striking rod between the lower driven position and the upper retracted position, to bring the rotating axis into deflection away from said striking rod for releasing the interference, said lift and release mechanism further including a biasing member which biases said toothed disc back to an original position of said toothed disc, said biasing member exerting a biasing force to said toothed disc to generate a counterclockwise torque of said toothed disc during driving of said fastener driving tool, said striking rod exerting an interfering force to said toothed disc to generate a clockwise torque when the non-meshing interference of said lift teeth of said striking rod by said first disc tooth of said toothed disc occurs, and wherein, when the clockwise torque is larger than the counterclockwise torque, said toothed disc is deflected clockwise so as to release the interference, said toothed disc defining a deflected center thereon which is at an opposite side relative to said piston in terms of a portion where the interfering force is exerted, one of said disc teeth being fixed to said peripheral portion of said toothed disc to serve as a deflected axle and defines a deflected axis that coincides with the deflected center of said toothed disc, said lift and release mechanism including a driving shaft which defines the rotating axis, said toothed disc having an arcuate hole through which said driving shaft extends to rotate said toothed disc about the rotating axis, said arcuate hole extending along a curve which surrounds the deflected axis.

2. The fastener driving tool as claimed in claim 1, wherein said lift and release mechanism further includes a first carrier half and a second carrier half between which said toothed disc is interposed, said driving shaft being supported on said first and second carrier halves, said deflected axle extending through said toothed disc and having two ends which are respectively fixed to said first and second carrier halves, said biasing member being in form of a torsion spring which is disposed between said second carrier half and said toothed disc and which has two ends respectively abutting against said second carrier half and said toothed disc.

3. The fastener driving tool as claimed in claim 1, wherein said striking rod has a notch formed in a rear side thereof, said toothed disc having a thrust protrusion projecting outwardly from said peripheral portion, said fastener driving tool further comprising a ratchet pawl which is pivotably mounted on a head thereof and which has a pawl end that is engageable in said notch when said striking rod is moved to the upper retracted position, said ratchet pawl having an actuated portion which extends toward said toothed disc, and wherein, with the rotation of said toothed disc, when said pawl end is engaged in said notch, and a terminal lift tooth of said striking rod meshes with a terminal disc tooth on said toothed disc, said thrust protrusion abuts against and thrusts said actuated portion to bring said pawl end into disengagement from said notch so as to permit said piston and said striking rod back to their normal striking state.

4. The fastener driving tool as claimed in claim 3, wherein, with the rotation of said toothed disc, when said striking rod is in the upper retracted position, said pawl end is kept in engagement with said notch and an impact generated as a result of sequential meshing of intermediate disc teeth on said toothed disc with said terminal lift tooth is borne by said ratchet pawl, until said terminal disc tooth is moved over said terminal lift tooth, said intermediate teeth being between a disc tooth which meshes with said terminal lift tooth when said striking rod just reaches the upper retracted position, and said terminal disc tooth.

5. The fastener driving tool as claimed in claim 4, further comprising a biasing spring which urges said pawl end of said ratchet pawl to abut against said striking rod and engage with said notch, said head of said fastener driving tool having a front head portion and a rear head portion, said ratchet pawl being disposed between said front and rear head portions.

6. The fastener driving tool as claimed in claim 5, wherein said head of said fastener driving tool defines an oil storing space between said front and rear head portions, and an oil filling hole in fluid communication with said oil storing space, said oil storing space being formed to permit oil therein to contact at least said terminal lift tooth of said striking rod.

7. The fastener driving tool as claimed in claim 6, wherein said oil storing space includes a first sealing compartment and a second sealing compartment, said head of said fastener driving tool having a first flexible material which is disposed in said first sealing compartment to absorb oil, and a second flexible material which is disposed in said second sealing compartment and which is rollably mounted between said front and rear head portions to be rolled by the movement of said striking rod, said lift teeth of said striking rod contacting said first and second flexible materials to obtain oil.

8. The fastener driving tool as claimed in claim 1, further comprising a gas storing chamber for supplying compressed gas to said cylinder, and a hose which is connected with said gas storing chamber and a gas supplying device.

9. The fastener driving tool as claimed in claim 1, wherein a terminal disc tooth is rollably mounted on said toothed disc by virtue of bearings so as to be rollable relative to said toothed disc.

* * * * *